US010492628B1

(12) United States Patent
Kennedy

(10) Patent No.: US 10,492,628 B1
(45) Date of Patent: Dec. 3, 2019

(54) SUSPENSION CASE

(71) Applicant: Fossils.com, LLC, Sheridan, WY (US)

(72) Inventor: David Kennedy, Conroe, TX (US)

(73) Assignee: Fossils.com, LLC, Sheridan, WY (US)

( * ) Notice: Subject to any disclaimer, the term of this patent is extended or adjusted under 35 U.S.C. 154(b) by 0 days.

(21) Appl. No.: 16/057,601

(22) Filed: Aug. 7, 2018

(51) Int. Cl.

| | |
|---|---|
| ***A47F 3/00*** | (2006.01) |
| ***B65D 51/24*** | (2006.01) |
| ***F21V 14/06*** | (2006.01) |
| ***B65D 43/02*** | (2006.01) |

(52) U.S. Cl.
CPC ..... *A47F 3/001* (2013.01); *B65D 43/022* (2013.01); *B65D 51/245* (2013.01); *B65D 51/248* (2013.01); *F21V 14/06* (2013.01); *B65D 2543/0049* (2013.01); *B65D 2543/00203* (2013.01); *B65D 2543/00546* (2013.01)

(58) Field of Classification Search
CPC .. B65D 43/022; B65D 51/245; B65D 51/248; B65D 2543/00203; B65D 2543/0049; B65D 2543/00546; A47F 3/001; F21V 14/06
See application file for complete search history.

(56) References Cited

FOREIGN PATENT DOCUMENTS

| | | | |
|---|---|---|---|
| CN | 201834403 U | * | 5/2011 |
| CN | 108657551 A | * | 10/2018 |

* cited by examiner

*Primary Examiner* — Mary Ellen Bowman
(74) *Attorney, Agent, or Firm* — Morse, Barnes-Brown & Pendleton, P.C.; Sean D. Detweiler, Esq.

(57) ABSTRACT

A suspension case has a first cap component, a female-male coupler component, a first elastic film held in tension and spanning flat across the female-male coupler component, a body component, a second elastic film held in tension and spanning flat across the body component, and a base component. Each component has interference fits with adjacent components to frictionally hold them together to form the suspension case. An object for display is frictionally mounted between the first and second elastic films. At least one magnification lens is disposed in the first cap component and/or the base component, which can be slidably mounted to move the at least one magnification lens toward or away from the object for display to adjust the focus and/or magnification. The first cap component and/or the base component can include an illumination source to direct light toward the object for display, thereby illuminating the object.

22 Claims, 9 Drawing Sheets

SUSPENSION CASE

FIELD OF THE INVENTION

The present invention relates to a suspension box suitable for displaying three-dimensional objects. In particular, the present invention relates to a suspension box having transparent walls enabling storage and viewing of an object for display contained therein, and additionally providing modular components, such as magnification and/or illumination of the object for display.

BACKGROUND

Generally, a suspension case is a form of display box that contains two pieces of planar parallel elastic film. An object for display is sandwiched between the two pieces of planar parallel elastic film and frictionally held in place therebetween.

However, such suspensions cases experience shortcomings. For example, the object for display may be a small item with intricate details that are difficult to view without removing the object for display from its location sandwiched between the two pieces of planar parallel elastic film, which is undesirable. In addition, more complex suspension cases are expensive to manufacture.

SUMMARY

There is a need for a low cost, portable, suspension case that provides an improved viewing experience for the user. The present invention is directed toward further solutions to address this need, in addition to having other desirable characteristics.

In accordance with embodiments of the present invention, a suspension case includes a first cap component having a top and a first stepped perimeter wall having a first at least one vertical side wall defining a first chamber within interior confines of the first stepped perimeter wall, the first at least one vertical side wall having an exterior wall surface external to the first chamber and an interior wall surface facing the first chamber, the exterior wall surface having the first stepped perimeter wall, which steps inward with a smaller perimeter wall surface than the exterior wall surface for a portion of the first stepped perimeter wall not in contact with the top, and which is configured as a first male coupler wall. A female-male coupler component has a second stepped perimeter wall with a second at least one vertical side wall defining a second chamber within interior confines of the second stepped perimeter wall, the second at least one vertical side wall having an interior wall surface facing the second chamber and an exterior wall surface outside, the exterior wall surface having the second stepped perimeter wall, with a female coupler portion on one half of the female-male coupler component and which steps inward with a smaller perimeter wall surface than the exterior wall surface for a portion of the second stepped perimeter wall, which is configured as a second male coupler portion of the female-male coupler component. A first elastic film is held in tension and spanning flat across the second chamber of the female-male coupler component and coupled with the second stepped perimeter wall. A body component has a third perimeter wall comprising a third at least one vertical side wall defining a third chamber and a fourth chamber within interior confines of the third perimeter wall, the third at least one vertical side wall having an interior wall surface facing the third chamber and the fourth chamber and an exterior wall surface outside, the exterior wall surface having the third perimeter wall, wherein the interior wall surface is sized and dimensioned for an interference fit with the second male coupler portion of the female-male coupler component and for an interference fit with a third male coupler wall of the base component. A second elastic film is held in tension and spanning flat across the third chamber of the body component and coupled with the third perimeter wall, the second elastic film separating the third chamber from the fourth chamber. A base component has a bottom and a fourth stepped perimeter wall comprising a fourth at least one vertical side wall defining a fifth chamber within interior confines of the fourth stepped perimeter wall, the fourth at least one vertical side wall having an exterior wall surface external to the fifth chamber and an interior wall surface facing the fifth chamber, the exterior wall surface having the fourth stepped perimeter wall, which steps inward with a smaller perimeter wall surface than the exterior wall surface for a portion of the fourth stepped perimeter wall not in contact with the bottom, and which creates the third male coupler wall. When the first male coupler wall of the first cap component is placed within the second chamber, the first male coupler wall of the first cap component fits snugly within the second chamber with an interference fit between the smaller perimeter wall surface of the first stepped perimeter wall pressed against the interior wall surface of the second stepped perimeter wall, resulting in the first male coupler wall and the female-male coupler component being frictionally held together. When the second male coupler portion of the female-male coupler component is placed within the third chamber of the body component, the second male coupler portion of the female-male coupler component fits snugly within the third chamber with an interference fit between the smaller perimeter wall surface of the second stepped perimeter wall pressed against the interior wall surface of the third perimeter wall of the body component and the third chamber, and the first elastic film is pressed against the second elastic film. When the third male coupler wall is placed within the fourth chamber of the body component, the third male coupler wall fits snugly within the fourth chamber with an interference fit between the smaller perimeter wall surface of the third male coupler wall pressed against the interior wall surface of the body component, resulting in the base component and the body component being frictionally held together.

In accordance with aspects of the present invention, the first cap component includes a magnification element positioned within the top and positioned to magnify light passing through the top of the first cap component. The magnification element of the first cap component can have a perimeter of a sufficient dimension and a height relative to an object for display to provide an appropriate focal length and magnification power to view magnification of the object for display and to provide a larger magnification when a distance of top from the object for display is increased. The base component can include a magnification element positioned within the bottom and positioned to magnify light passing through the bottom of the base component. The magnification element of the base component can have a perimeter of a sufficient dimension and a height relative to an object for display to provide an appropriate focal length and magnification power to view magnification of the object for display and to provide a larger magnification when a distance of the bottom of the base component from the object for display is increased.

In accordance with aspects of the present invention, the first cap component, the female-male coupler component, and the body component form a display case when coupled together. When an object for display is placed between the first elastic film and the second elastic film, the object for display is suspended between the first elastic film and the second elastic film as they stretch around and frictionally hold the object for display in suspension. The first elastic film and the second elastic film abut each other in a parallel planar manner when the case is in a fully assembled configuration.

In accordance with aspects of the present invention, the suspension case can be constructed from plastic. The first cap component can include a first illumination source positioned within the top and positioned to direct illuminating light toward the first elastic film to illuminate contents of the case. The base component can include a second illumination source positioned to direct illuminating light toward the second elastic film to illuminate contents of the case.

In accordance with embodiments of the present invention, a suspension case includes a first cap component having a top, a first stepped perimeter wall, which is configured as a first male coupler wall. A female-male coupler component has a second stepped perimeter wall with an interior wall surface, the second stepped perimeter wall configured as a second male coupler portion. A first elastic film is held in tension and spanning flat across the second chamber of the female-male coupler component and coupled with the second stepped perimeter wall. A body component has a third perimeter wall with an interior wall surface, and a third chamber and a fourth chamber within interior confines of the third perimeter wall, wherein the interior wall surface is sized and dimensioned for an interference fit with the second male coupler portion of the female-male coupler component and for an interference fit with a third male coupler wall of the base component. A second elastic film is held in tension and spanning flat across the third chamber of the body component and coupled with the third perimeter wall, the second elastic film separating the third chamber from the fourth chamber. A base component has a bottom and a fourth stepped perimeter wall, configured as the third male coupler wall. When the first male coupler wall of the first cap component is placed within the second chamber, the first male coupler wall of the first cap component fits snugly within the second chamber with an interference fit between the first stepped perimeter wall pressed against the interior wall surface of the second stepped perimeter wall, resulting in the first male coupler wall and the female-male coupler component being frictionally held together. When the second male coupler portion of the female-male coupler component is placed within the third chamber of the body component, the second male coupler portion of the female-male coupler component fits snugly within the third chamber with an interference fit between the second stepped perimeter wall pressed against the interior wall surface of the third perimeter wall of the body component and the third chamber, and the first elastic film is pressed against the second elastic film. When the third male coupler wall is placed within the fourth chamber of the body component, the third male coupler wall fits snugly within the fourth chamber with an interference fit between the third male coupler wall pressed against the interior wall surface of the body component, resulting in the base component and the body component being frictionally held together. When the first cap component, the female-male coupler component, the body component, and the base component are all frictionally coupled with each other the combination results in the suspension case in a fully assembled configuration.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
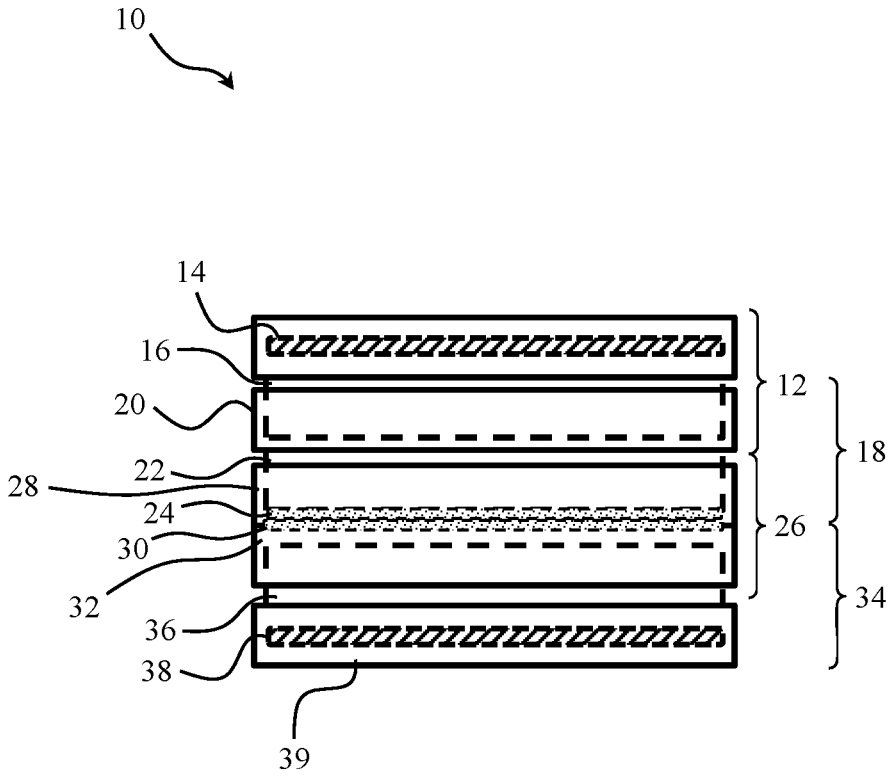
FIG. 1 is a side view illustration of a suspension case in accordance with the present invention.

An illustrative embodiment of the present invention relates to a suspension case having a first cap component, a female-male coupler component, a first elastic film held in tension and spanning flat across the female-male coupler component, a body component, a second elastic film held in tension and spanning flat across the body component, and a base component. Each of the first cap component, the female-male coupler component, the body component, and the base component have an interference fit with an adjacent component to frictionally hold the components together in a predetermined order (first cap component coupled with the female-male component, coupled with the body component, coupled with the base component) to form the suspension case. When the female-male component is pressed together with the body component, the first elastic film is pressed against the second elastic film. An object for display is positioned between the first and second elastic films, and frictionally held in place when the suspension case is fully assembled. The suspension case incudes at least one magnification lens disposed in the first cap component and/or the base component. The at least one magnification lens enables a magnified view of the object for display when it is disposed in the suspension case. The first cap component and/or the base component can be slidably mounted with the suspension case in such a way that the at least one magnification lens can be moved toward or away from the object for display to adjust or vary the focus and/or quantity of magnification via a change in distance from the object for display. The first cap component and/or the base component can additionally and/or alternatively include an illumination source to direct light toward the object for display, thereby illuminating the object.

FIG. 1 through FIG. 9B, wherein like parts are designated by like reference numerals throughout, illustrate an example embodiment or embodiments of a suspension case, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

Figure 2:
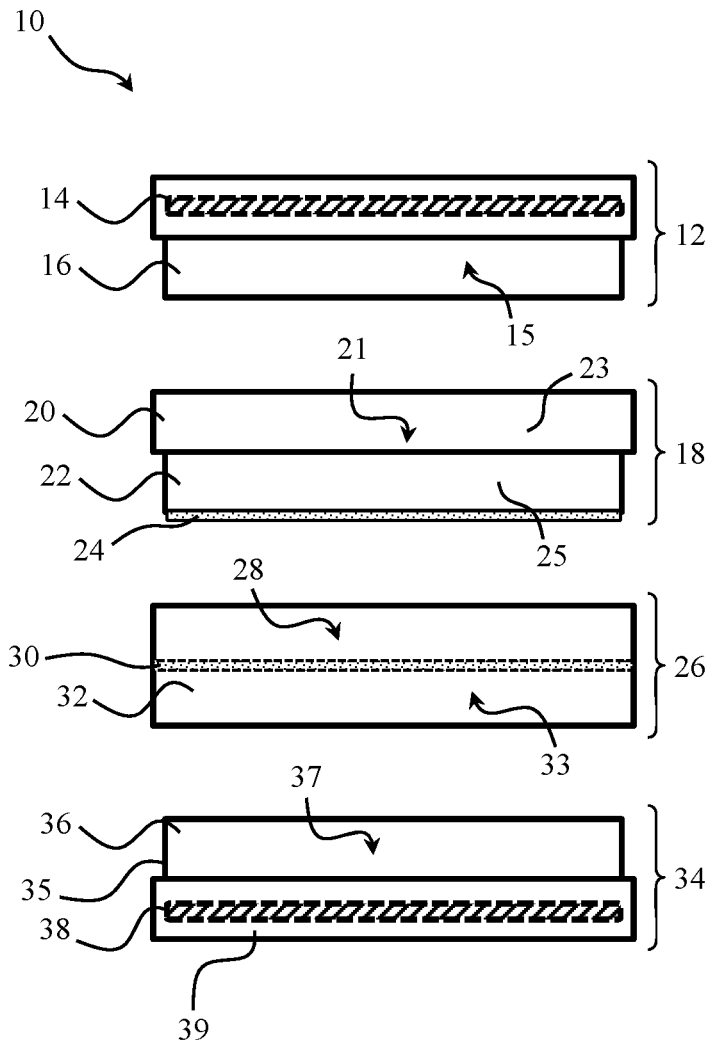
FIG. 2 is a side exploded view of the suspension case.

FIG. 1 and FIG. 2 are side views illustrating a suspension case 10 in accordance with embodiments of the present invention. FIG. 1 shows a fully assembled suspension case 10. FIG. 2 shows separate components of the suspension case 10 in exploded view. A first cap component 12 includes a magnification lens 14 disposed in a top section of the first cap component 12. A first stepped perimeter wall defines a first chamber 15 within interior confines of the first stepped perimeter wall. The first stepped perimeter wall steps inward for a portion, which creates a first male coupler wall 16.

A female-male coupler component 18 has a second stepped perimeter wall 22 having a second at least one vertical side wall defining a second chamber 21 within interior confines of the second stepped perimeter wall 22. The second at least one vertical side wall has an interior wall surface facing the second chamber 21 and an exterior wall surface outside, the exterior wall surface having the second stepped perimeter wall 22. A female coupler portion 23 resides on one half of the female-male coupler component 18 and steps inward with a smaller perimeter wall surface than the exterior wall surface for a portion of the second stepped perimeter wall 22 to form a second male coupler portion 25 of the female-male coupler component 18.

A first elastic film 24 is held in tension and spanning flat across the second chamber 21 of the female-male coupler component 18 and coupled with the second stepped perimeter wall 22.

A body component 26 has a third perimeter wall 32 with a third at least one vertical side wall defining a third chamber 28 and a fourth chamber 33 within interior confines of the third perimeter wall 32. The third at least one vertical side wall has an interior wall surface 29 (see FIG. 6A) facing the third chamber 28 and the fourth chamber 33 and an exterior wall surface outside, the exterior wall surface being the third perimeter wall 32. The interior wall surface 29 is sized and dimensioned for an interference fit with the second male coupler portion 25 of the female-male coupler component 18 and for an interference fit with a third male coupler wall 36 of a base component 34.

A second elastic film 30 is held in tension and spanning flat across the third chamber 28 of the body component 26 and coupled with the third perimeter wall 32. The third chamber 28 and the fourth chamber 33 are separated by the second elastic film 30.

The base component 34 has a bottom 39 and a fourth stepped perimeter wall 36 having a fourth at least one vertical side wall defining a fifth chamber 37 within interior confines of the fourth stepped perimeter wall 36. The fourth at least one vertical side wall has an exterior wall surface external to the fifth chamber 37 and an interior wall surface facing the fifth chamber 37, the exterior wall surface being the fourth stepped perimeter wall 36, which steps inward with a smaller perimeter wall surface than the exterior wall surface for a portion of the fourth stepped perimeter wall 36 that is not in contact with the bottom 39, and which creates the third male coupler wall 35.

When the first male coupler wall 16 of the first cap component 12 is placed within the second chamber 21, the first male coupler wall 16 of the first cap component 12 fits snugly within the second chamber 21 with an interference fit between the smaller perimeter wall surface of the first stepped perimeter wall pressed against the interior wall surface of the second stepped perimeter wall 22. This results in the first male coupler wall 16 and the female-male coupler component 18 being frictionally held together.

When the second male coupler portion 25 of the female-male coupler component 18 is placed within the third chamber 28 of the body component 26, the second male coupler portion 25 of the female-male coupler component 18 fits snugly within the third chamber 28 with an interference fit between the smaller perimeter wall surface of the second stepped perimeter wall 22 pressed against the interior wall surface 29 of the third perimeter wall 32 of the body component 26 and the third chamber 28, and the first elastic film 24 is pressed against the second elastic film 30.

When the third male coupler wall 35 is placed within the fourth chamber 33 of the body component 26, the third male coupler wall 35 fits snugly within the fourth chamber 33 with an interference fit between the smaller perimeter wall surface of the third male coupler wall 35 pressed against the interior wall surface of the body component 34. This results in the base component 34 and the body component 26 being frictionally held together.

Figure 4A:
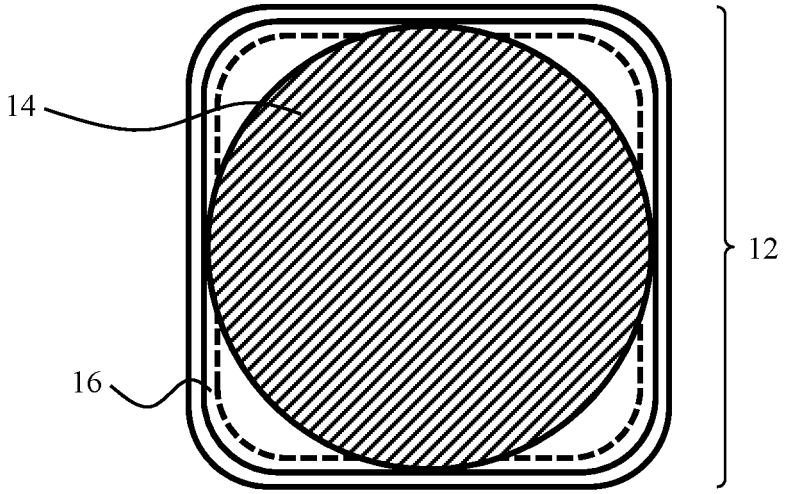
FIG. 4A is a top view of a first cap component of the suspension case.
Figure 4B:
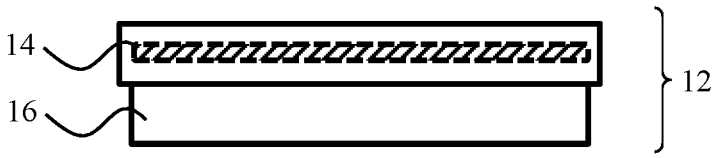
FIG. 4B is a side view of the first cap component of FIG. 4A.

FIGS. 4A and 4B show a top view and a side view of the first cap component 12. The magnification lens 14 is incorporated into the first cap component 12. If an object for display 44 is positioned in the suspension case 10, it is placed between the first elastic film 24 and the second elastic film 30 before the female-male coupler component 18 is inserted into the body component 26. Once appropriately placed, the object for display 44 is frictionally held in place between the first elastic film 24 and the second elastic film 30 and is further viewable through the magnification lens 14 down into the suspension case 10.

Figure 5A:
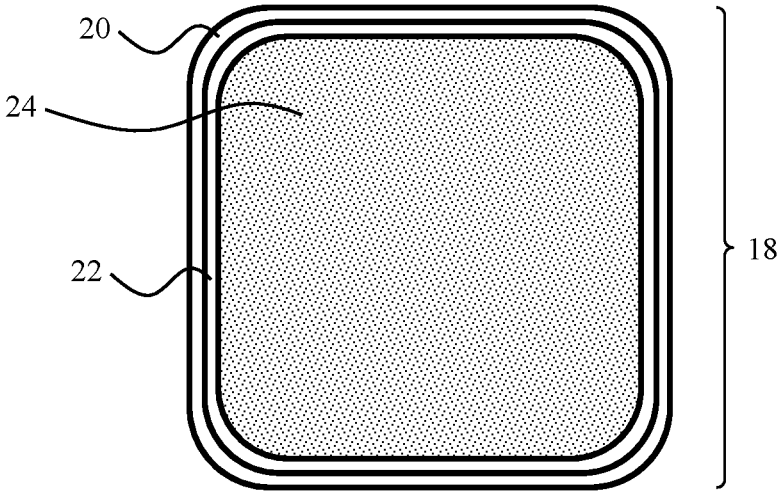
FIG. 5A is a top view of a female-male coupler component of the suspension case.
Figure 5B:
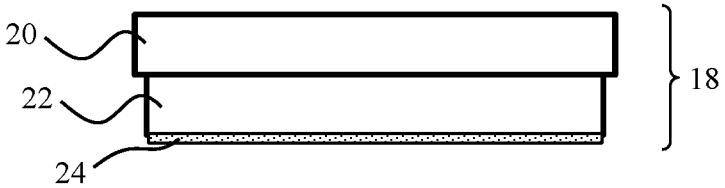
FIG. 5B is a side view of the female-male coupler component of FIG. 5A.

FIGS. 5A and 5B show a top view and a side view of the female-male coupler component 18. The first elastic film 24 spans across the female-male coupler component 18, and is transparent, enabling viewing through the first elastic film 24. The second stepped perimeter wall 22 is sized, dimensioned, and structured to fit within and enable an interference or friction fit with the third perimeter wall 32 with the third at least one vertical side wall defining the third chamber 28. When the female-male coupler component 18 is placed within the third chamber 28, the first elastic film 24 and the second elastic film 30 are arranged generally planar parallel to each other, and if the female-male coupler component 18 is pressed sufficiently into the third chamber 28 into a fully assembled position, the surface of the first elastic film 24 abuts and makes contact with the surface of the second elastic film 30. In implementations where the object for display 44 is too large, it is possible that the female-male coupler component 18 to not be capable of being pressed into the fully assembled position, but may instead be required to hold in a position that is part way inserted into the third chamber 28. This configuration is acceptable despite not being in the fully assembled position because the interference or friction fit of the female-male coupler component 18 holds the components 18 and 26 together, frictionally, with a gap existing between the first elastic film 24 and the second elastic film 30. However, in most instances, the first elastic film 24 and the second elastic film 30 are capable of flexing and stretching in an elastic manner to enable the object for display 44 to exist sandwiched between the two films 24, 30, with the two films 24, 30 elastically stretched to accommodate the object for display 44 and still be abutting and in contact with each other near their perimeter edges.

Figure 3:
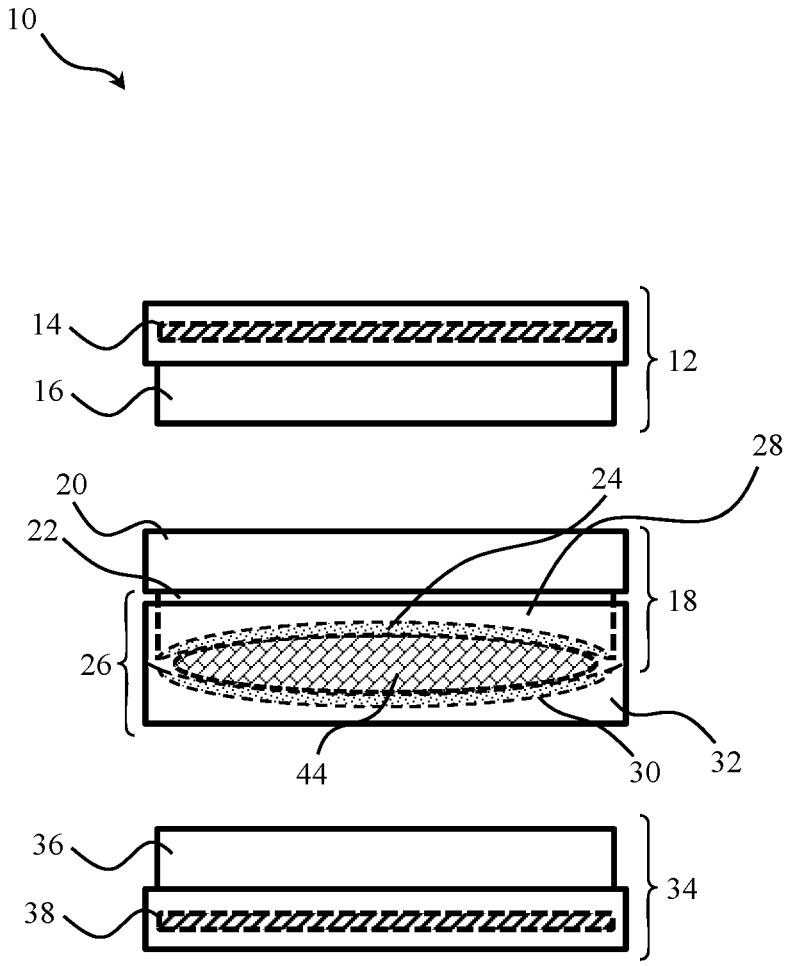
FIG. 3 is a side partially exploded view of the suspension case, showing an object for display disposed therein.

A depiction of the fully assembled position with the object for display 44 sandwiched between the first elastic film 24 and the second elastic film 30 is shown in FIG. 3, where the suspension case 10 is depicted in partially exploded view (with the first cap component 12 and the base component 34 not coupled or in fully assembled position with the female-male coupler component 18 or the body component 26, respectively. Further details and operational arrangements of the elastic film 24 relative to the second elastic film 30 as they hold the object for display 44 sandwiched therebetween are not necessary to provide in further detail herein, as they are known by those of skill in the art.

Figure 6A:
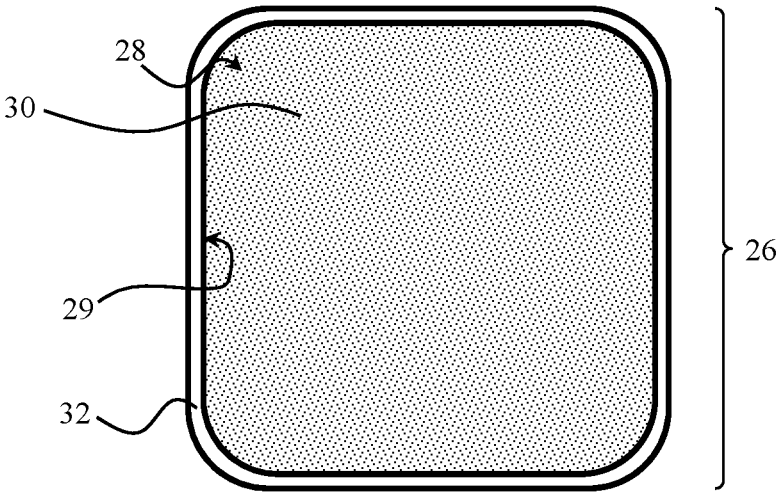
FIG. 6A is a top view of a body component of the suspension case.
Figure 6B:
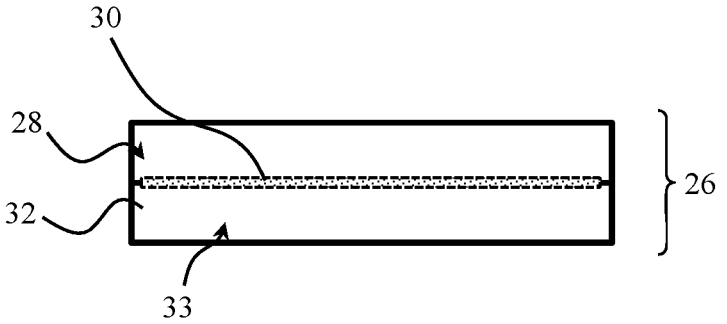
FIG. 6B is a side view of the body component of FIG. 6A.

FIGS. 6A and 6B show a top view and a side view of the body component 26. The second elastic film 30 spans across the body component 26. The third at least one vertical side wall has the interior wall surface 29 facing the third chamber 28. The second elastic film 30 provides defining separation between the third chamber 28 and the fourth chamber 33.

Figure 7A:
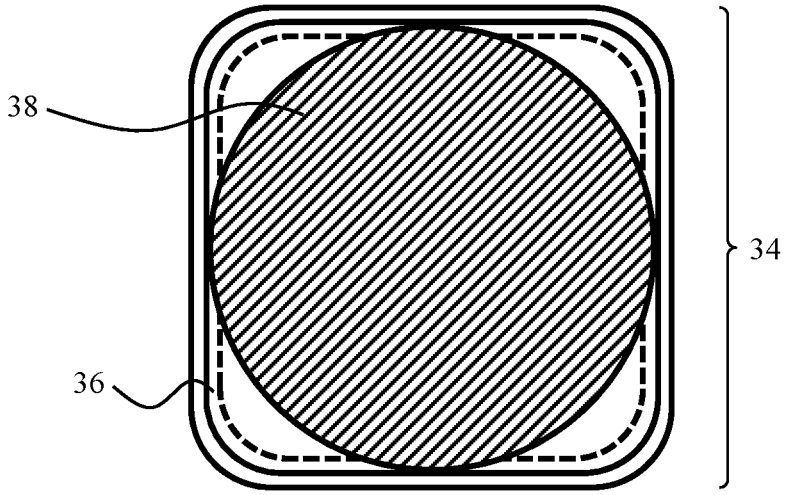
FIG. 7A is a bottom view of a base component of the suspension case.
Figure 7B:
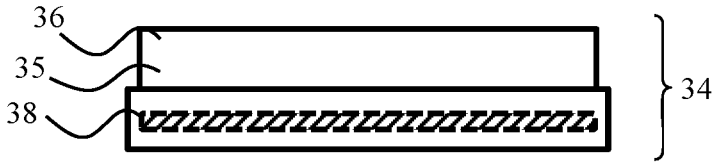
FIG. 7B is a side view of the base component of FIG. 7A.

FIGS. 7A and 7B show a bottom view and a side view of the base component 34. A second magnification lens 38 is incorporated into the base component 34. If an object for display 44 is positioned in the suspension case 10, it is placed between the first elastic film 24 and the second elastic film 30 before the female-male coupler component 18 is inserted into the body component 26. Once appropriately placed, the object for display 44 is frictionally held in place between the first elastic film 24 and the second elastic film 30 and is further viewable through the second magnification lens 38 into the suspension case 10. It should be noted that the second magnification lens 38 can be provided independent of the magnification lens 14 of the first cap component 12.

Figure 8A:
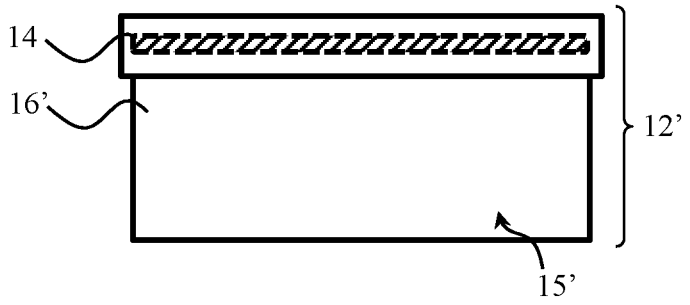
FIG. 8A is a side view of a first cap component with an extended coupling sleeve.
Figure 8B:
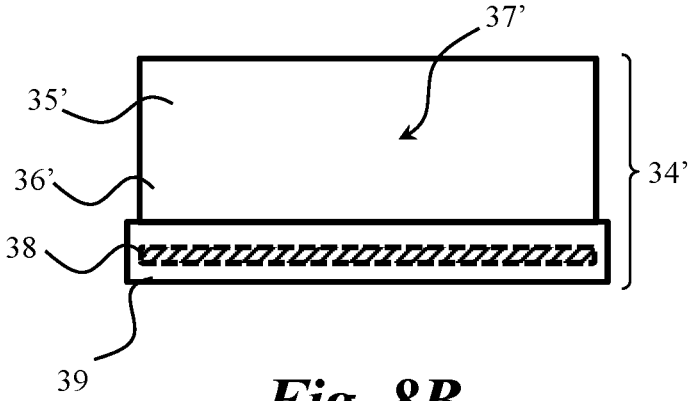
FIG. 8B is a side view of a base component with an extended coupling sleeve.

FIGS. 8A and 8B show a first cap component 12' having a larger dimension stepped perimeter wall that defines a first chamber 15' within interior confines of the first stepped perimeter wall. The first stepped perimeter wall steps inward for a portion, which creates a first male coupler wall 16' that of a larger dimension than that of the first male coupler wall 16 depicted in earlier figures herein. Also shown is a base component 34' has a bottom 39' and a fourth stepped perimeter wall 36' having a fourth at least one vertical side wall defining a fifth chamber 37' within interior confines of the fourth stepped perimeter wall 36'. The fourth at least one vertical side wall has an exterior wall surface external to the fifth chamber 37' and an interior wall surface facing the fifth chamber 37', the exterior wall surface being the fourth stepped perimeter wall 36', which steps inward with a smaller perimeter wall surface than the exterior wall surface for a portion of the fourth stepped perimeter wall 36' that is not in contact with the bottom 39, and which creates the third male coupler wall 35'. The third male coupler wall 35' is of a larger dimension than that of the third male coupler wall 35 depicted in earlier figures herein. The function of the larger dimension first male coupler wall 16' and the larger dimension third male coupler wall 35' created a larger length for telescoping out the magnification lens 14 and the second magnification lens 38 further from the object for display 44. As such, in the embodiments illustrated in FIGS. 8A and 8B enable a longer telescoping length for adjusting the focus and magnification of the object for display as viewed through the magnification lens 14 and second magnification lens 38.

Figure 9A:
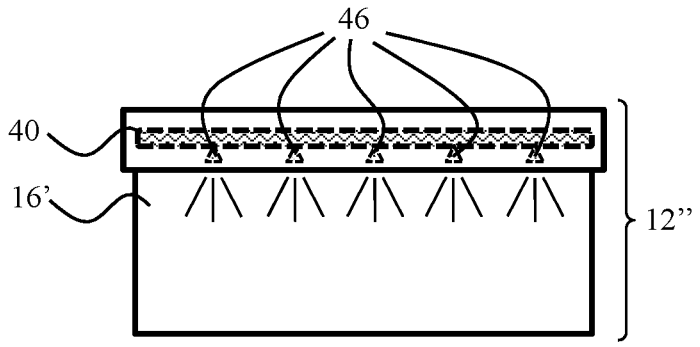
FIG. 9A is a side view of a first cap component with an illumination source.
Figure 9B:
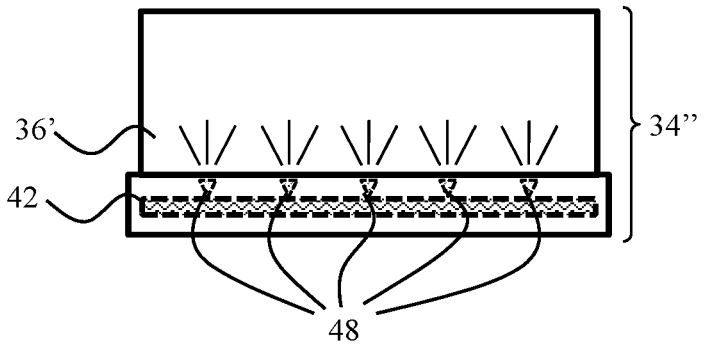
FIG. 9B is a side view of a base component with an illumination source.

FIGS. 9A and 9B show the additional component of a first illumination source 46 and a second illumination source 48. As depicted, the first and second illumination sources 46, 48 direct illuminating light in the direction of the object for display 44 in the interior section of the suspension case 10. Those of skill in the art will appreciate that the illumination sources 46, 48 can be any known form of suitable illumination, such as light emitting diode (LED), incandescent, etc., and can be powered by battery, rechargeable battery, solar panel, or other conventional power source. Further, the first and second illumination sources 46, 48 can both be implemented at the same time, or can independently be implemented as one or the other on the suspension case 10.

The suspension case 10 can be manufactured of a number of different materials. Specifically, the a first cap component 12, female-male coupler component 18, body component 26, and base component 34 can all be made of a number of suitable materials, including plastic, acrylic, polystyrene, composite, or any clear or transparent material, at least with regard to the top and bottom horizontal pieces. The vertical walls, in accordance with certain aspects and embodiments of the present invention, do not need to be clear or transparent. As such, they can be manufactured of additional materials, such as metal, wood, composite, opaque plastic, or the like. The first elastic film 24 and second elastic film 30 can be made of any number of flexible elastic materials, such as polyester (PET) film, thermoplastic polyurethane (TPU) film, or the like. Specific dimensions, thickness, clarity/transparency, and the like are readily determined by those of skill in the art of suspension cases using such elastic films. In addition, the interference friction fit that holds together the components as described can be replaced with conventional latches or other mechanical fastener devices, as would be appreciated by those of skill in the art, such that the present invention is not limited to embodiments relying only on interference fits.

In operation, the object for display 44 is placed onto the second elastic film 30. The female-male coupler component 18 is placed into the third chamber 28 of the body component 26 and slid down toward the second elastic film 30. Depending on how large the object for display 44 is, the female-male coupler component 18 can be slid all the way down until it abuts the second elastic film 30, or part way down as the object for display 44 interferes with and stops the female-male coupler component 18 from moving further. The first cap component 12 is placed into the second chamber 21 of the female-male coupler component 18 and slid down until it abuts the step of the second stepped perimeter wall 22. The base component 34 is placed into the fourth chamber 33 and slid up until it abuts the step of the fourth stepped perimeter wall 36 against the body component 26. Notably, the order in which the base component 34 or the first cap component 12 are coupled with the other components does not matter. Likewise, the order in which any of the components is removably coupled with the other components to form the suspension case 10 also does not matter. The components can be combined in any order, as would be appreciated by those of skill in the art.

Once all components are removably coupled with each other to form the suspension case 10, the suspension case 10 is considered to be in fully assembled configuration (as depicted in FIG. 1, object for display 44 not shown in this figure). In the fully assembled configuration, the object for display 44 is viewable through either or both of the first cap component 12 and the base component 34 because they are both transparent. In embodiments where a magnification lens 14 or a second magnification lens 38 are provided, such magnification lenses 14, 38 enable magnification of the object for display 44. The magnification and focus can be further manually adjusted with the sliding in or out of either the first cap component 12 or the base component 34, as desired, to adjust the focal length to the object of desire 44. Those of skill in the art will appreciate the magnification lenses 14,38 have a perimeter of a sufficient dimension and a height relative to an object for display 44 to provide an appropriate focal length and magnification power to view magnification of the object for display 44 and to provide a larger magnification when a distance of top from the object for display 44 is increased. For example, as those of skill in the art will appreciate, magnification can be selected for the magnification lens 14 or second magnification lens 38 based on variables such as working distance, field of view, eye relief distance, depth of field, and magnification. The magnifying power of a lens depends on its focal length, which depends on the lens curvature. As is known, the greater the curvature, the shorter the focal length and the greater the power. In the selection of a simple, inexpensive magnification lens 14, 38, the lens diameter will typically decrease as the curvature increases to provide higher power. Additional details concerning magnification are not required herein for purposes of enablement as the variables are known and conventional, as such, additional description will not be provided herein. Likewise, in embodiments where the first illumination source 46 or the second illumination source 48 are provided, the object for display 44 is illuminated by turning on the appropriate illumination source 46, 48. Selection of a particular LED with particular low voltage and power source are within the capability of those of skill in the art, thus additional details are not required for purposes of enablement and additional description will not be provided herein. The end result being a transparent suspension case 10 that provides magnification and/or illumination of objects for display 44 placed therein, provided in in a low cost, transportable, suspension case 10, in accordance with the present invention.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may existing in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Unless otherwise noted or defined herein, to the extent directional vocabulary is utilized, the disclosure and figures are described with reference to a conventional three-dimensional coordinate axis system of X, Y and Z, where the X direction is generally left-right or east-west, the Y direction is generally in-out, relative to the plane of the page of the document, and the Z direction is generally up-down or north-south on the page. Further as utilized herein, the terms "horizontal" and "vertical" are utilized consistent with their conventional definitions as would be appreciated by those of skill in the art, and as generally illustrated and expanded upon below. For example, in the fields of physics, engineering, and construction, the direction designated as vertical is usually that along which a plumb-bob hangs in response to the force of gravity. The direction of horizontal is considered along a line or plane that is normal or orthogonal to the vertical plane. As such, moving in a horizontal direction (horizontally) is effectively equivalent to traveling across the earth's surface, e.g., moving forward, backward, left, right, etc., along the ground, while moving in a vertical direction (vertically) is effectively equivalent to moving up (away from the ground) or down (toward or into the ground). Merging the X, Y, Z coordinate access with the terms vertical and horizontal, the Z-axis lies in the vertical direction and the X and Y axes lie in the horizontal plane with the vertical Z axis being orthogonal thereto. To the extent any ambiguity is generated by the specific wording of the above explanations, it is anticipated that such ambiguity may be interpreted and clarified consistent with the conventional interpretations of the terms horizontal and vertical.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A suspension case, comprising:

a first cap component having a top and a first stepped perimeter wall comprising a first at least one vertical side wall defining a first chamber within interior confines of the first stepped perimeter wall, the first at least one vertical side wall having an exterior wall surface external to the first chamber and an interior wall surface facing the first chamber, the exterior wall surface having the first stepped perimeter wall, which steps inward with a smaller perimeter wall surface than the exterior wall surface for a portion of the first stepped perimeter wall not in contact with the top, and which is configured as a first male coupler wall;

a female-male coupler component having a second stepped perimeter wall comprising a second at least one vertical side wall defining a second chamber within interior confines of the second stepped perimeter wall, the second at least one vertical side wall having an interior wall surface facing the second chamber and an exterior wall surface outside, the exterior wall surface having the second stepped perimeter wall, with a female coupler portion on one half of the female-male coupler component and which steps inward with a smaller perimeter wall surface than the exterior wall surface for a portion of the second stepped perimeter wall, which is configured as a second male coupler portion of the female-male coupler component;

a first elastic film held in tension and spanning flat across the second chamber of the female-male coupler component and coupled with the second stepped perimeter wall;

a body component having a third perimeter wall comprising a third at least one vertical side wall defining a third chamber and a fourth chamber within interior confines of the third perimeter wall, the third at least one vertical side wall having an interior wall surface facing the third chamber and the fourth chamber and an exterior wall surface outside, the exterior wall surface having the third perimeter wall, wherein the interior wall surface is sized and dimensioned for an interference fit with the second male coupler portion of the female-male coupler component and for an interference fit with a third male coupler wall of the base component;

a second elastic film held in tension and spanning flat across the third chamber of the body component and coupled with the third perimeter wall, the second elastic film separating the third chamber from the fourth chamber;

a base component having a bottom and a fourth stepped perimeter wall comprising a fourth at least one vertical side wall defining a fifth chamber within interior confines of the fourth stepped perimeter wall, the fourth at least one vertical side wall having an exterior wall surface external to the fifth chamber and an interior wall surface facing the fifth chamber, the exterior wall surface having the fourth stepped perimeter wall, which steps inward with a smaller perimeter wall surface than the exterior wall surface for a portion of the fourth stepped perimeter wall not in contact with the bottom, and which creates the third male coupler wall;

wherein when the first male coupler wall of the first cap component is placed within the second chamber, the first male coupler wall of the first cap component fits snugly within the second chamber with an interference fit between the smaller perimeter wall surface of the first stepped perimeter wall pressed against the interior wall surface of the second stepped perimeter wall, resulting in the first male coupler wall and the female-male coupler component being frictionally held together;

wherein when the second male coupler portion of the female-male coupler component is placed within the third chamber of the body component, the second male coupler portion of the female-male coupler component fits snugly within the third chamber with an interference fit between the smaller perimeter wall surface of the second stepped perimeter wall pressed against the interior wall surface of the third perimeter wall of the body component and the third chamber, and the first elastic film is pressed against the second elastic film; and wherein when the third male coupler wall is placed within the fourth chamber of the body component, the third male coupler wall fits snugly within the fourth chamber with an interference fit between the smaller perimeter wall surface of the third male coupler wall pressed against the interior wall surface of the body component, resulting in the base component and the body component being frictionally held together.

2. The case of claim 1, wherein the first cap component comprises a magnification element positioned within the top and positioned to magnify light passing through the top of the first cap component.

3. The case of claim 2, wherein the magnification element of the first cap component has a perimeter of a sufficient dimension and a height relative to an object for display to provide an appropriate focal length and magnification power to view magnification of the object for display and to provide a larger magnification when a distance of top from the object for display is increased.

4. The case of claim 1, wherein the base component comprises a magnification element positioned within the bottom and positioned to magnify light passing through the bottom of the base component.

5. The case of claim 4, wherein the magnification element of the base component has a perimeter of a sufficient dimension and a height relative to an object for display to provide an appropriate focal length and magnification power to view magnification of the object for display and to provide a larger magnification when a distance of the bottom of the base component from the object for display is increased.

6. The case of claim 1, wherein the first cap component, the female-male coupler component, and the body component form a display case when coupled together.

7. The case of claim 1, wherein when an object for display is placed between the first elastic film and the second elastic film, the object for display is suspended between the first elastic film and the second elastic film as they stretch around and frictionally hold the object for display in suspension.

8. The case of claim 1, wherein the first elastic film and the second elastic film abut each other in a parallel planar manner when the case is in a fully assembled configuration.

9. The case of claim 1, wherein the suspension case is constructed from plastic.

10. The case of claim 1, wherein the first cap component comprises a first illumination source positioned within the top and positioned to direct illuminating light toward the first elastic film to illuminate contents of the case.

11. The case of claim 1, wherein the base component comprises a second illumination source positioned to direct illuminating light toward the second elastic film to illuminate contents of the case.

12. A suspension case, comprising:

a first cap component having a top, a first stepped perimeter wall, which is configured as a first male coupler wall;

a female-male coupler component having a second stepped perimeter wall with an interior wall surface, the second stepped perimeter wall configured as a second male coupler portion;

a first elastic film held in tension and spanning flat across the second chamber of the female-male coupler component and coupled with the second stepped perimeter wall;

a body component having a third perimeter wall with an interior wall surface, and a third chamber and a fourth chamber within interior confines of the third perimeter wall, wherein the interior wall surface is sized and dimensioned for an interference fit with the second male coupler portion of the female-male coupler component and for an interference fit with a third male coupler wall of the base component;

a second elastic film held in tension and spanning flat across the third chamber of the body component and coupled with the third perimeter wall, the second elastic film separating the third chamber from the fourth chamber;

a base component having a bottom and a fourth stepped perimeter wall, configured as the third male coupler wall;

wherein when the first male coupler wall of the first cap component is placed within the second chamber, the first male coupler wall of the first cap component fits snugly within the second chamber with an interference fit between the first stepped perimeter wall pressed against the interior wall surface of the second stepped perimeter wall, resulting in the first male coupler wall and the female-male coupler component being frictionally held together;

wherein when the second male coupler portion of the female-male coupler component is placed within the third chamber of the body component, the second male coupler portion of the female-male coupler component fits snugly within the third chamber with an interference fit between the second stepped perimeter wall pressed against the interior wall surface of the third perimeter wall of the body component and the third chamber, and the first elastic film is pressed against the second elastic film;

wherein when the third male coupler wall is placed within the fourth chamber of the body component, the third male coupler wall fits snugly within the fourth chamber with an interference fit between the third male coupler wall pressed against the interior wall surface of the body component, resulting in the base component and the body component being frictionally held together; and wherein when the first cap component, the female-male coupler component, the body component, and the base component are all frictionally coupled with each other the combination results in the suspension case in a fully assembled configuration.

13. The case of claim 12, wherein the first cap component comprises a magnification element positioned within the top and positioned to magnify light passing through the top of the first cap component.

14. The case of claim 13, wherein the magnification element of the first cap component has a perimeter of a sufficient dimension and a height relative to an object for display to provide an appropriate focal length and magnification power to view magnification of the object for display and to provide a larger magnification when a distance of top from the object for display is increased.

15. The case of claim 12, wherein the base component comprises a magnification element positioned within the bottom and positioned to magnify light passing through the bottom of the base component.

16. The case of claim 15, wherein the magnification element of the base component has a perimeter of a sufficient dimension and a height relative to an object for display to provide an appropriate focal length and magnification power to view magnification of the object for display and to provide a larger magnification when a distance of the bottom of the base component from the object for display is increased.

17. The case of claim 12, wherein the first cap component, the female-male coupler component, and the body component form a display case when coupled together.

18. The case of claim 12, wherein when an object for display is placed between the first elastic film and the second elastic film, the object for display is suspended between the first elastic film and the second elastic film as they stretch around and frictionally hold the object for display in suspension.

19. The case of claim 12, wherein the first elastic film and the second elastic film abut each other in a parallel planar manner when the case is in the fully assembled configuration.

20. The case of claim 12, wherein the suspension case is constructed from plastic.

21. The case of claim 12, wherein the first cap component comprises a first illumination source positioned within the top and positioned to direct illuminating light toward the first elastic film to illuminate contents of the case.

22. The case of claim 12, wherein the base component comprises a second illumination source positioned to direct illuminating light toward the second elastic film to illuminate contents of the case.

* * * * *